United States Patent [19]

Sawyer

[11] 3,971,331

[45] July 27, 1976

[54] PLASTIC BARRICADE PANEL

[76] Inventor: Michael J. Sawyer, 5705 Tucker, Omaha, Nebr. 68152

[22] Filed: Mar. 1, 1974

[21] Appl. No.: 447,388

[52] U.S. Cl. ..... 116/63 P; 40/125 H

[51] Int. Cl.[2] ..... E01F 9/10; G09F 7/12

[58] Field of Search ..... 116/63 R, 63 P; 40/125 H, 125 N; 117/47 A

[56] References Cited

UNITED STATES PATENTS

| | | | |
|---|---|---|---|
| 2,454,648 | 11/1948 | Green | 40/125 H |
| 2,648,097 | 8/1953 | Kritchever | 117/47 A |
| 2,802,443 | 8/1957 | Hanson | 116/63 P |
| 3,153,872 | 10/1964 | Walter | 116/63 P X |
| 3,490,749 | 1/1970 | Anderson | 116/63 P |
| 3,593,681 | 7/1971 | Sernovitz | 40/125 H X |
| 3,766,881 | 10/1973 | Ward | 40/125 H X |
| 3,798,814 | 3/1974 | Harmon | 116/63 R |

FOREIGN PATENTS OR APPLICATIONS

| | | | |
|---|---|---|---|
| 1,436,788 | 3/1966 | France | 116/63 P |

*Primary Examiner*—Richard C. Queisser
*Assistant Examiner*—Daniel M. Yasich
*Attorney, Agent, or Firm*—Hiram A. Sturges

[57] ABSTRACT

A movable barricade for use at construction sites having supporting legs connected by rails and further having at least one of its rails formed by a panel of thermoplastic material having a flame-oxidized forward surface to which pressure sensitive adhesive material is attached and arranged for delivering a warning message, the back surface of the panel having protruding ribs formed of the same piece of material as the remainder of the panel.

10 Claims, 7 Drawing Figures

PLASTIC BARRICADE PANEL

FIELD OF THE INVENTION

This invention is in the field of movable barricades for construction sites and along roadways.

DESCRIPTION OF THE PRIOR ART

Barricades of the prior art have had their rails made of either wood or metal.

Wooden rails have had many disadvantages since they will weather so that their paint tends to come off. At times, a barricade will actually be laying in a mud puddle.

During manufacture of wooden barricade rails, it is necessary to cut the wood and drill the wood for bolts, and these are time-consuming and costly steps.

When wooden rails are used, it has been necessary to apply pressure sensitive reflective tape by pressing the tape on between rollers, as is costly. When tape of a non-pressure sensitive type has been used, it has been necessary to attach it by vacuum and with the use of heat, this is also a costly procedure.

In addition to these disadvantages, wood is becoming more expensive and it is easily damaged since barricades take considerable abuse, sometimes being hit by cars.

Metal has had many disadvantages for use in barricade panels. It is easily damaged by being struck by automobiles, since it must be of light gauge for sufficiently low cost whereby it becomes easily bent.

It is not possible or practical to completely straighten a metal panel after it has once been bent.

Metal has a further disadvantage in that it has sharp edges which are dangerous and the use of metal has a high cost because it must be protected from corrosion by first of all being treated for corrosion resistance or painted.

The use of thermoplastic has not reached popularity because a thermoplastic panel is ordinarily weak and it is an object of this invention to solve this problem by providing the concept of a thermoplastic panel provided with ribs protruding from its rearward side so as to provide the panel with strength but with the thickness of the panel from front to back being lesser in areas between the ribs for economy of manufacture, the ribs being made of one piece with the remainder of the panel for the economy of simultaneous molding.

Plastic panels have had the further disadvantage that the kinds of highway reflective tape that are now in demand on barricade panels will not adhere to plastic material in its ordinary form well enough to stay in place in substantial use over periods of time out in the weather.

It is an object of this invention to provide the concept of flame-oxidizing the surface of a plastic panel preparatory to the attachment thereto of reflective tape made of adhesive coated highly reflective material, whereby the reflective material adheres to the barricade panel in a durable fashion capable of withstanding adequately long periods of use of a barricade out in the weather.

Therefore, a particular object of this invention is to provide a barricade having panels of thermoplastic material which will effectively maintain thereon, through long use, the kind of highly reflective tape that is now required on barricades by federal specifications, accomplished by means of flame-oxidizing of the material before the reflective tape is attached.

Therefore, it is an object of this invention to provide a barricade panel or rail which is light in weight, impervious to water, requires no painting maintenance, has a consistently smooth surface to which tape is attached, has great tensile strength to retard damage upon impact, has a consistency of size and dimensions of its panels without costly cutting steps, which is of low cost, durable, and of attractive appearance.

SUMMARY OF THE INVENTION

A movable barricade for use at construction sites having supporting legs connected by rails and further having at least one of its rails formed by a panel of thermoplastic material having a flame-oxidized forward surface to which pressure sensitive adhesive material is attached and arranged for delivering a warning message, the back surface of the panel having protruding ribs formed of the same piece of material as the remainder of the panel, said ribs comprising a rear annular border rib surrounding and intersecting diagonal ribs which latter also intersect one another for providing great strength, the panel having special corner portions of greater thickness for providing strength at bolt holes where they are attached to the legs, the panel further having a forwardly protruding border portion serving to add to the thickness of the panel and providing further strength, although the remainder of the forward portion is flat for receiving pressure sensitive adhesive material.

DESCRIPTION OF THE PREFERRED EMBODIMENT

Figure 5:
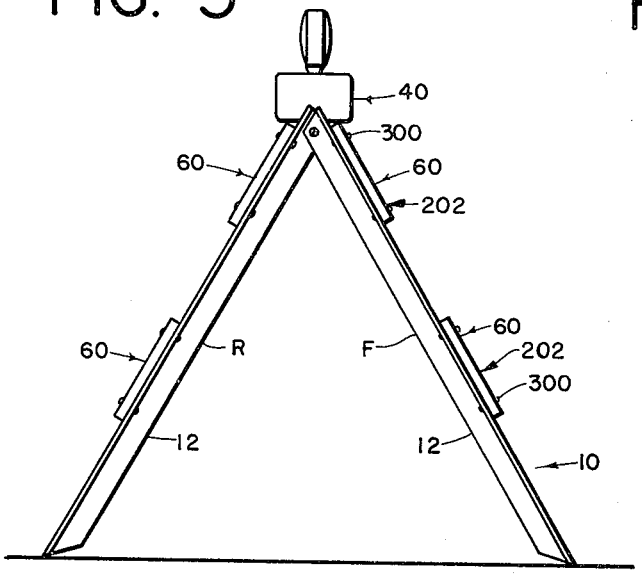
FIG. 5 is an end view of a barricade using the panels of this invention.
Figure 6:
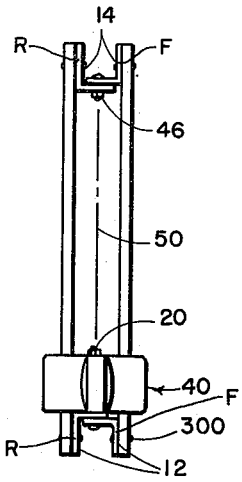
FIG. 6 is a top view of the barricade of FIG. 5.

Referring to FIG. 5, the barricade of this invention is there generally indicated at 10 and has two right legs 12 and two left legs 14, the latter being best seen in FIG. 6.

The right legs 12 are connected together by a bolt 20 which also extends through a warning light assembly 40 and secures the latter to the remainder of the barricade.

The left legs 14 are attached together by a smaller bolt and nut assembly 46, and the bolt and nut assemblies 20 and 46 are aligned with each other for a hinging action so that the barricade can be folded into the position shown in FIG. 6 and unfolded in the position shown in FIG. 5.

The bolt and nut assemblies 20 and 46 attach the upper ends of the legs 12 and the legs 14 together respectively, for hinging about a horizontal axis 50.

The legs 12 and 14 are made of angle iron and it can now be said that all parts of the barricade that have been described herein up to this point are conventional, and the new features of this invention will now be described.

Interconnecting the right and left legs 12 and 14 on one side of the barricade are rails or panels generally indicated at 60 and these are two in number, ordinarily, disposed spaced apart from each other and one above the other in with upper and lower edge in parallelism, as is customary.

Two other similar rails or panels 60 interconnect the right and left legs 12 and 14 on the other side of the barricade, as is also conventional.

Figure 7:
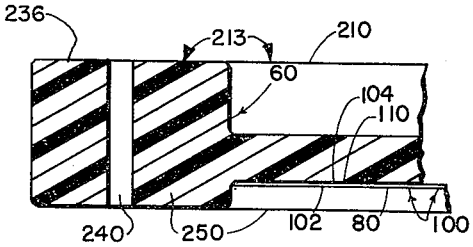
FIG. 7 is a detail similar to FIG. 3 except that the scale is larger and with the further exception that the reflective tape on the forward side is shown in place.

However, in accordance with this invention, the panels 60 are made with large, flat, forward surface areas 70 on each panel which are rectangular in shape and which are adapted to receive covering means 80 which is black and other covering means 90 which is white, each covering means preferably being in the form of an inclined stripe and at least some of the covering means being formed by tape 100 having a highly reflective outer surface 102 and having a backside 104 having a pressure sensitive adhesive coating 110 thereon, as best seen in FIG. 7, which latter will be found not to stick to thermoplastic material well over a long period of time of use as required in barricades under ordinary circumstances and with ordinary thermoplastic material.

Figure 4:
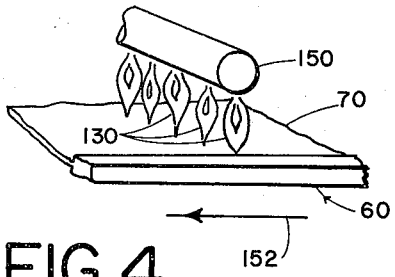
FIG. 4 is a diagrammatic detail showing a panel passing under a flame device so that its forward surface is flame-oxidized, only a portion of the panel and a portion of the flame device are shown and the remainder broken away for convenience of illustration.

For this reason, the thermoplastic panel 60 of this invention is given special treatment as seen in FIG. 4 so that its forward surface 70 is oxidized by flame 130 as it passes under a suitable flame source such as, for example, a pipe 150 containing gas issuing from perforations therein, whereby as the panel 60 passes under the flame 130, its surface 70 becomes flame-oxidized, even though the passage under the flame is quick, and this has the effect of making the adhesive-coated, standard, popular, highly reflective tape now being used on barricades adhere to the panel with a durability suitable for the long life and outdoor use of a barricade panel.

It is necessary that the warning tapes 80 and 90 be of a suitable color and shape for indicating to a viewer a meaningful message in the form of the standard warning indicated by alternating white and black diagonally arranged strips.

In place of alternate strips that are black, it is not necessary that these be covered with tape, since the black area need not be reflected and, therefore, a black plastic resin coloring can be used. But, in cases where orange tapes are used over a white background, it is desirable that both the orange and white be reflective.

This invention is not to be understood as being limited to the particular color or shape or nature of the tape which is applied.

After the tape has been applied to the flame-oxidized forward surface 70 of the panels, the panels can be attached to the legs of the barricade by means of bolts 300.

Figure 2:
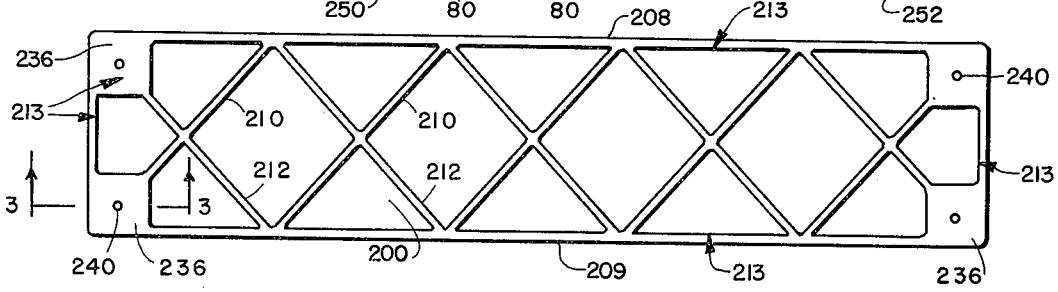
FIG. 2 is a rear elevation of one of the panels or rails.
Figure 3:
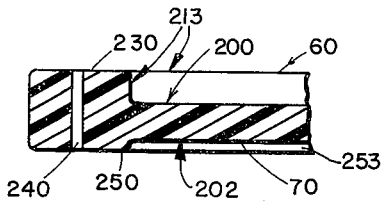
FIG. 3 is a sectional view taken along the line 3—3 of FIG. 2.

The rails or panels of this invention can be of various dimensions within the spirit of this invention, but by way of example only, can be one-half of an inch thick at maximum, as seen in FIG. 3, 36 inches long, as seen in FIG. 2, 12 inches high. Each panel has an inner side generally indicated at 200 and an outer side generally indicated at 202. On the inner side 200 are a plurality of first ribs 210 which are spaced apart equidistantly with respect to each other and which are disposed in parallelism with each other and which are arranged at an angle of 45° with respect to the straight upper and lower edges 208 and 209 of the panel, the latter edges being parallel to each other.

A plurality of second ribs 212 are provided which are straight and parallel with each other and which are disposed at an angle of 45° with respect to the straight upper and lower edges 208 and 209 of the panel, the second ribs 212 intersecting the ribs 210 at a right angle respectively. The ribs 210 and 212 are shown in FIG. 2 as transverse to each other and intersecting.

The rearward side 200 of the panel further has an annular rib 213 extending entirely around the outer edge of the panel and intersecting respective ones of the ribs 210 and 212. The annular rib 213 has certain relatively large portions at 236 at the corners of the panel where the rib 213 is covering much larger areas at the corner as the panel is seen looking at it from the rearward side.

The large corner areas 236 of the rib 213 tend to make the corners much stronger and this is important because it is at the corner portions 236 of the rib 213 where holes 240 extend through the panel through which suitable securing means 300 can be placed for securing the panels to the legs, as best seen in FIG. 5.

Accordingly, the panel is much thicker at the corners than it is at places between the various ribs 210, 212, and 213.

Figure 1:
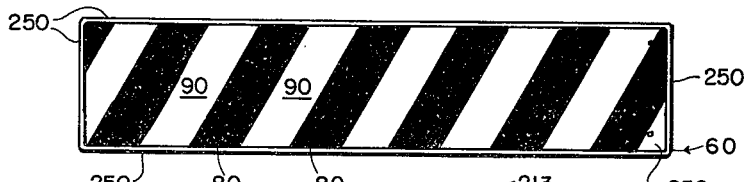
FIG. 1 is a frontal elevation of one of the barricade rails or panels of this invention shown with its covering of pressure sensitive reflective tape.

As best seen in FIG. 3, the outer side 202 of the panel is substantially planar except for a border rib 250 which can be seen in FIG. 1 to extend all the way around the forward side of the panel at its outer edges, having certain portions at its corners of larger area, as seen at 252, so that the corners are further reinforced, thus providing one central recess indicated at 253 in FIG. 3 which is very shallow and which provides the flat forward surface 70 on which the pressure sensitive adhesive material or tapes 80 and 90 are disposed, as above described.

As best seen in FIG. 5, the legs comprise a pair of right legs 12 and a pair of left legs 14, each of the pairs of legs having a forward leg F and a rearward leg R. The legs 12 are horizontally spaced from the legs 14, as seen in FIG. 6

The legs of each pair of legs 12 or 14 incline divergently downward with respect to each other forwardly and rearwardly respectively, as best seen in FIG. 5, when they are in a position of use on a roadway.

While the panels 60 are also called rails herein, it is important to recognize that in the type of barricade involved, at least one of the rails interconnects the forward legs F together and is formed of a material separate from the legs and is preferably formed of plastic, as above described.

Also, at least one of the rails 60 interconnects the rearward legs R together and is formed of a material separate from the legs and preferably of the thermoplastic material, as described.

Each of the legs is generally straight. Each panel 60 is substantially rigid and strong for giving structural strength to the barricade.

The forward legs F are preferably connected by two panels which are vertically spaced apart. The rearward legs are likewise preferably connected by two panels 60 which are vertically spaced apart, whereby wind can blow therebetween. All panels preferably have the pressure sensitized tape 100 thereon.

As can be seen in FIG. 5, each panel has its outer surface 202, which faces away from the respective legs, disposed generally parallel with the legs which it is attached to, since both the panels and the legs incline with respect to the vertical, the term "generally parallel" being used because the recess 253 is so shallow.

The type of plastic to be used for the rail can include plastics with fillers, such as glass fiber filler, plastics without fillers, earthen plastics, a combination of plastics with fillers and earthen plastics, laminated ridged foam plastics, pressed plastics and thermoplastic materials of various kinds.

I claim:

1. A warning barricade of the type having legs, said barricade being self-supporting when on a horizontal surface, said barricade having spaced horizontal rails connected to its legs, said legs comprising a pair of right legs and a pair of left legs, each of said pairs of legs comprising a forward leg and a rearward leg, said pairs of legs being horizontally spaced apart, the legs of each pair inclining divergently downward with respect to each other forwardly and rearwardly respectively, at least one of said rails connecting said forward legs together and being formed of material separate from said legs, at least one of said rails connecting said rearward legs together and being formed of material separate from said rearward legs, said legs each being generally straight, said rails being formed by a panel of thermoplastic material, said panel pretreated with means for oxidizing other than atmospheric so as to an oxidized forward surface, pressure-sensitive adhesive material attached to said forward surface, said material being of a color and shape for indicating to a viewer a meaningful message, the back surface of said panel being constructed to have substantially rigid and strong for giving structural strength to said barricade.

2. The barricade of claim 1 said forward surface is flame-oxidized by said oxidizing means.

3. The barricade of claim 1 further comprising said panel having a back surface having ribs protruding therefrom for providing strength, said ribs being formed of the same piece of material as the remainder of said panel for low-cost manufacture, said panel being of lesser thickness from its front-to-back sides in areas between said ribs for economy of manufacture, said ribs comprising spaced first ribs each transverse to and intersecting one of a plurality of spaced second ribs, said ribs and the remainder of said panel being formed of one-piece of material.

4. The barricade of claim 3 in which said ribs comprise a rear annular rib surrounding said first and second ribs and intersecting said first and second ribs.

5. The barricade of claim 3 in which said first and second ribs intersect each other at a right angle.

6. The barricade of claim 3 in which said panel has special corner portions of greater thickness than said panel portions of lesser thickness, each of said special corner portions having a hole therethrough, securing means in said holes and connecting said panel to two of said legs.

7. The barricade of claim 3 in which said panel has a forwardly protruding border portion around its forward side and of substantial thickness for providing strength.

8. The barricade of claim 1 in which one leg of each of said pairs is interconnected by said panel and by a second panel likeunto said panel, and in which said panels are vertically spaced apart, whereby wind can blow therebetween, said panels each having said pressure-sensitive adhesive material thereon.

9. The barricade of claim 1 having said panels each having holes therethrough, attachment means connecting each of said panels to its respective legs and extending through said panel holes respectively.

10. The barricade of claim 1 in which said back surface of said panels have ribs protruding outwardly therefrom, said panel and its ribs being formed of the same one piece of material whereby said ribs provide strength and also economy.

* * * * *